US006206643B1

(12) United States Patent
Jeong

(10) Patent No.: US 6,206,643 B1
(45) Date of Patent: Mar. 27, 2001

(54) METHOD FOR CONTROLLING RECIPROCATING COMPRESSOR HAVING VARIABLE CAPACITY

(75) Inventor: Won-Bae Jeong, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/333,934

(22) Filed: Jun. 16, 1999

(30) Foreign Application Priority Data

Jun. 17, 1998 (KR) ..... 98/22680

(51) Int. Cl.[7] ..... F04B 49/06; H02P 1/26; H02P 5/28

(52) U.S. Cl. ..... 417/45; 417/42; 318/778; 318/808

(58) Field of Search ..... 417/42, 45, 44.1; 318/778, 807

(56) References Cited

U.S. PATENT DOCUMENTS

| | | | | |
|---|---|---|---|---|
| Re. 33,620 | * | 6/1991 | Persem | 62/215 |
| 2,629,075 | * | 2/1953 | Deschmann | 318/147 |
| 4,100,466 | * | 7/1978 | Schroeder | 318/102 |
| 4,401,933 | * | 8/1983 | Davy et al. | 318/778 |
| 4,422,030 | * | 12/1983 | McAllise | 318/779 |
| 4,481,455 | * | 11/1984 | Sugimoto | 318/778 |
| 4,566,289 | * | 1/1986 | Iizuka et al. | 62/228.4 |
| 4,633,382 | * | 12/1986 | Upadhyay et al. | 363/132 |
| 4,652,807 | * | 3/1987 | Nagura | 318/778 |
| 4,724,680 | * | 2/1988 | Kawai | 62/115 |
| 4,785,225 | * | 11/1988 | Horie et al. | 318/811 |
| 4,959,969 | * | 10/1990 | Okamoto et al. | 62/157 |
| 5,088,297 | * | 2/1992 | Maruyama et al. | 62/228.4 |
| 5,164,651 | * | 11/1992 | Hu et al. | 318/778 |
| 5,179,842 | * | 1/1993 | Kanazawa | 62/158 |
| 5,422,557 | * | 6/1995 | Lee et al. | 318/807 |
| 5,444,344 | * | 8/1995 | Vincent | 318/599 |

* cited by examiner

*Primary Examiner*—Timothy S. Thorpe
*Assistant Examiner*—Timothy P. Solak
(74) *Attorney, Agent, or Firm*—Robert E. Bushnell, Esq.

(57) ABSTRACT

A method of controlling a reciprocating compressor comprising of starting the reciprocating compressor at a minimum speed in which a frequency of 45–52 Hz is applied, operating the reciprocating compressor at a frequency of 52~60 Hz and operating the reciprocating compressor at a predetermined rotational speed. Therefore, an optimum amount of lubricating oil is supplied to a sliding part of the reciprocating compressor so that the reliability of parts thereof is secured.

3 Claims, 4 Drawing Sheets

METHOD FOR CONTROLLING RECIPROCATING COMPRESSOR HAVING VARIABLE CAPACITY

CLAIM OF PRIORITY

This application makes reference to, incorporates the same herein, and claims all benefits accruing under 35 U.S.C. §119 from an application for METHOD FOR CONTROLLING RECIPROCATING COMPRESSOR HAVING VARIABLE CAPACITY earlier filed in the Korean Industrial Property Office on Jun 17, 1998 and there duly assigned Serial No.22680/1998.

BACKGROUND OF THE INVENTION

1. Field of the Invention

The present invention relates to a compressor for a cooling apparatus, and more particularly, to a method for controlling a reciprocating compressor having variable capacity, which is capable of varying a rotational speed thereof.

2. Description of the Related Art

Generally, a compressor is used for compressing a refrigerant at a high temperature and a high pressure, which circulates in an apparatus for generating cool air. There are many kinds of compressors such as a reciprocating compressor, a rotary compressor, a brushless direct current (BLDC) compressor and an inverter type compressor.

A single-phase induction motor is typically used in the reciprocating compressor and the rotary compressor. As shown in FIG. 1, a frequency of 50 or 60 Hz is used to start the compressors. In the above mentioned compressors which use the single-phase induction motor, only an on/off operation of the compressors is controlled without any variation of a rotational speed thereof.

Meanwhile, in an reciprocating compressor having variable capacity, the rotational speed of the compressor can be controlled by varying a supplied voltage or frequency. Therefore, a flow rate of the refrigerant is facilely adjusted by the variation of the rotational speed of the compressor, whereby the cooling apparatus itself can be directly controlled. FIG. 3 shows a structure of a control board in connection with the reciprocating compressor having variable capacity.

In the FIG. 3, a motor 1 of the reciprocating compressor having variable capacity is driven by an inverter 3 operated by an output signal from a programmable array logic (PAL) 2. The PAL 2 is controlled by a microcomputer 10. The rotational speed of the motor 1 is input to the microcomputer 10 through a back emf sensing part 4. Therefore, the microcomputer 10 precisely controls the speed of the motor 1 referring to the input data of the speed of the motor 1.

The microcomputer 10 comprises a mode selecting part 11, a commutator 12 which receives a signal from the mode selecting part 11 and outputs a commutation signal to the PAL 2, a step signal generating part 13 which generates a step signal and transmits the step signal to the mode selecting part 11, a digital-phase shifter 14 which converts the signal of the rotational speed from the back emf sensing part 4 into a correspondent digital phase shifter signal and transmits the digital phase shifter signal to the mode selecting part 11, and a PWM pulse part 15 which applies a pulse width modulation (PWM) signal to the PAL 2.

However, in the above mentioned reciprocating compressor having variable capacity, there is a problem that, since an angular velocity of a shaft of the compressor is much lower than that of the conventional compressor using the single-phase induction motor, a lubricating oil is not sufficiently supplied to a sliding portion of the compressor when the compressor is operated at a minimum speed, whereby a reliability of parts of the compressor is lowered.

To overcome the above problem, there has been suggested a method which starts a compressor at a frequency of 58 Hz. However, in the method, there is a problem.

In addition, in the conventional reciprocating compressor having variable capacity, there is a problem that a noise and vibration due to a sudden change of the rotational speed of the compressor is generated when changing the speed from the maximum to the minimum or reversely.

SUMMARY OF THE INVENTION

It is therefore an object of the present invention to secure the reliability of the parts of the compressor when starting and reduce the switching loss of the control board.

The other object of the present invention is to minimize the generating of the noise and vibration due to a sudden change of the rotational speed.

To achieve the above objects and other advantages, there is provided A method of controlling a reciprocating compressor comprising of:

starting the reciprocating compressor at a minimum speed in which a frequency of 45–52 Hz is applied; and operating the reciprocating compressor at a predetermined rotational speed.

Further, according to the present invention, the method according to claim 1, further comprising a step of operating the reciprocating compressor at a frequency of 52–60 Hz before operating at the predetermined rotational speed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention now will be described more fully hereinafter with reference to the accompanying drawings, in which preferred embodiments of the invention are shown.

Figure 1:
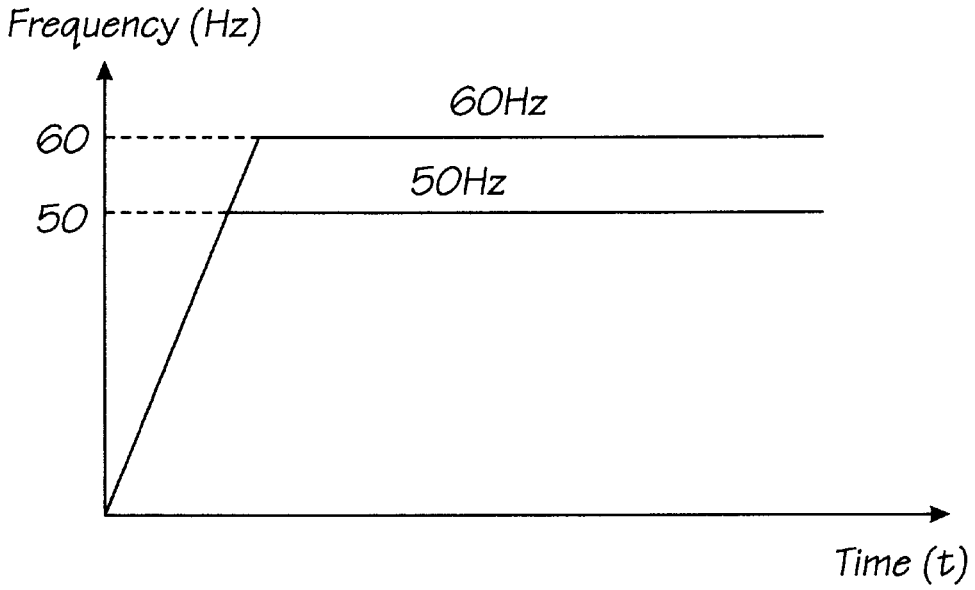
FIG. 1 is a graph connected with a starting method of a conventional compressor using a single-phase motor.
Figure 2:
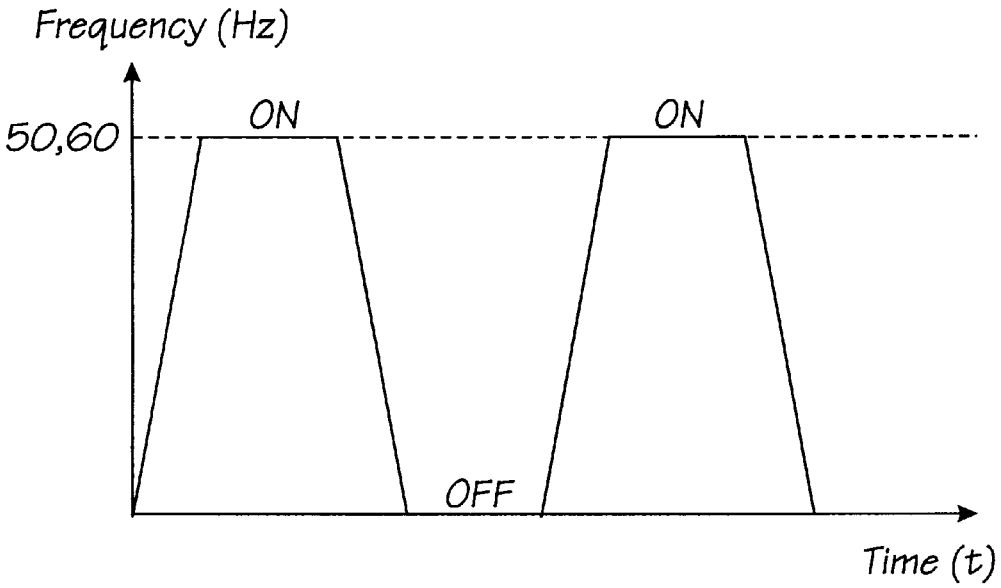
FIG. 2 is a graph connected with a operation control method of the conventional compressor using a single-phase motor.
Figure 3:
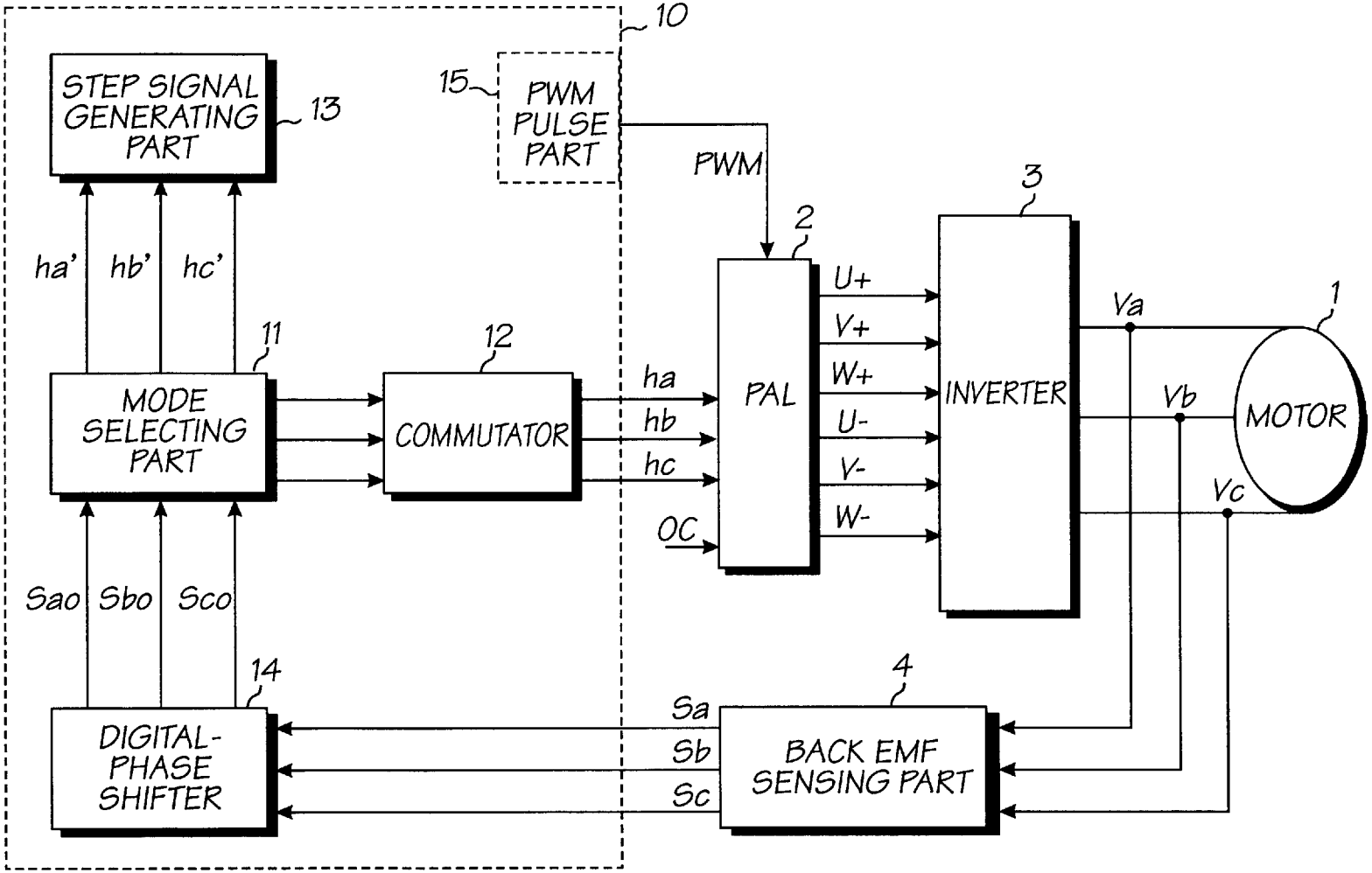
FIG. 3 is a block diagram of a control board of a reciprocating compressor having variable capacity.
Figure 4:
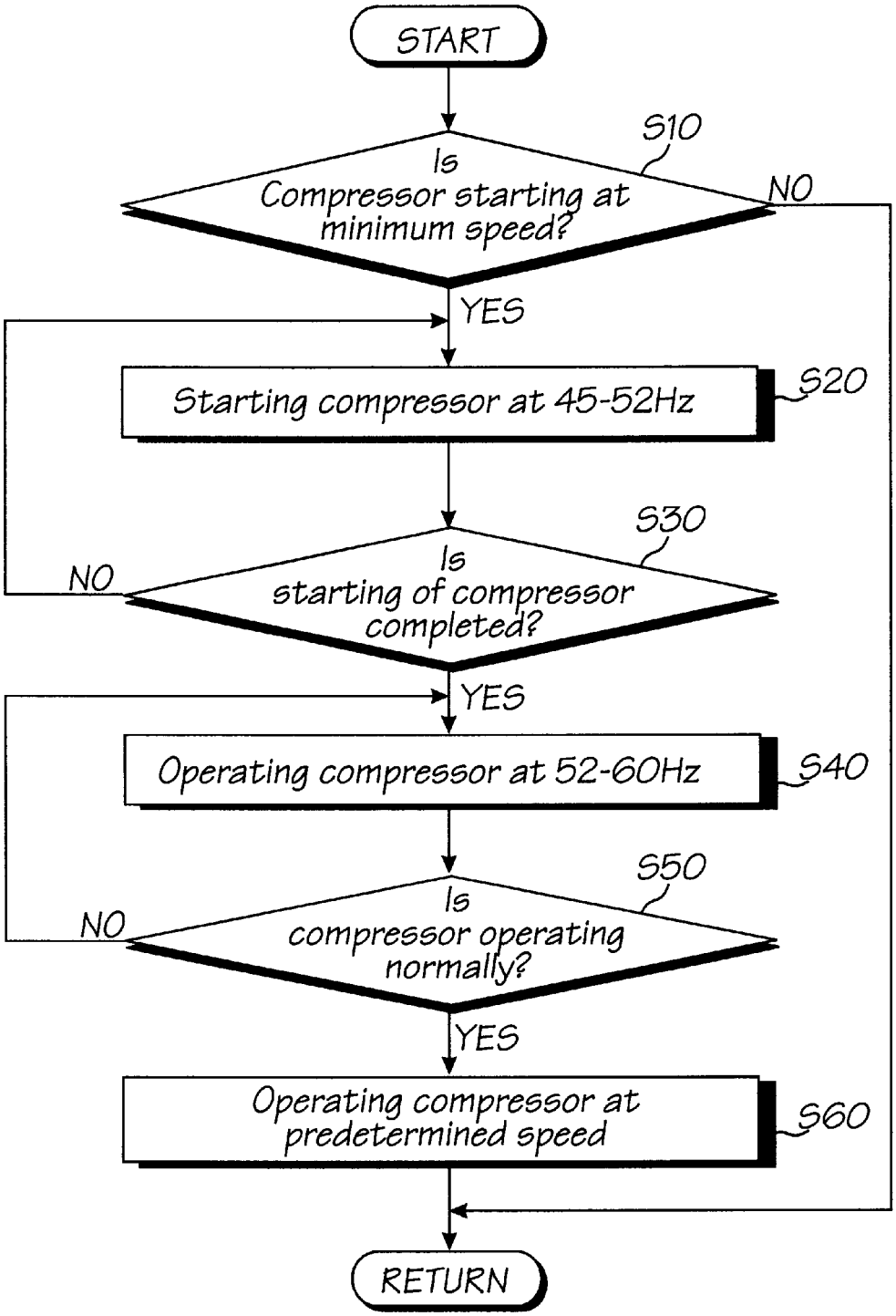
FIG. 4 is a flow diagram of a operation control method of a reciprocating compressor having variable capacity according to the present invention.

In FIGS. 3 and 4, a method of controlling a reciprocating compressor having variable capacity according to the present invention is as follows:

First of all, it is determined whether the reciprocating compressor is started at a minimum rotational speed (S10). If the reciprocating compressor is started at the minimum rotational speed, the reciprocating compressor is started at a frequency of 45–52 Hz (S20). Then, it is determined whether the starting of the reciprocating compressor is completed at the starting frequency (S30). If the starting of the reciprocating compressor is completed, the reciprocating compressor is operated at a frequency of 52–60 Hz (S40). Sequentially, it is determined whether the reciprocating compressor is normally operated at the operating frequency (S50). If the reciprocating compressor is normally operated at the operating frequency (S50), the reciprocating compressor is operated at a predetermined speed (S60).

The starting frequency (45~52 Hz) and the operating frequency (52~60 Hz) applied to the present invention are obtained by a experimentation. That is, as a result of a analysis of data obtained by the experimentation, if the starting frequency is applied to the reciprocating compressor when starting, an optimum amount of lubricating oil is supplied to a sliding part of the reciprocating compressor and the reliability of parts thereof is secured. In addition, if the operating frequency is applied to the reciprocating compressor after completion of the starting, a noise and vibration due to a sudden change of the rotational speed is minimized when varying the rotational speed from a minimum speed to a maximum speed or reversely.

The operation of the reciprocating compressor having variable capacity according to the present invention is described more fully.

Figure 5:
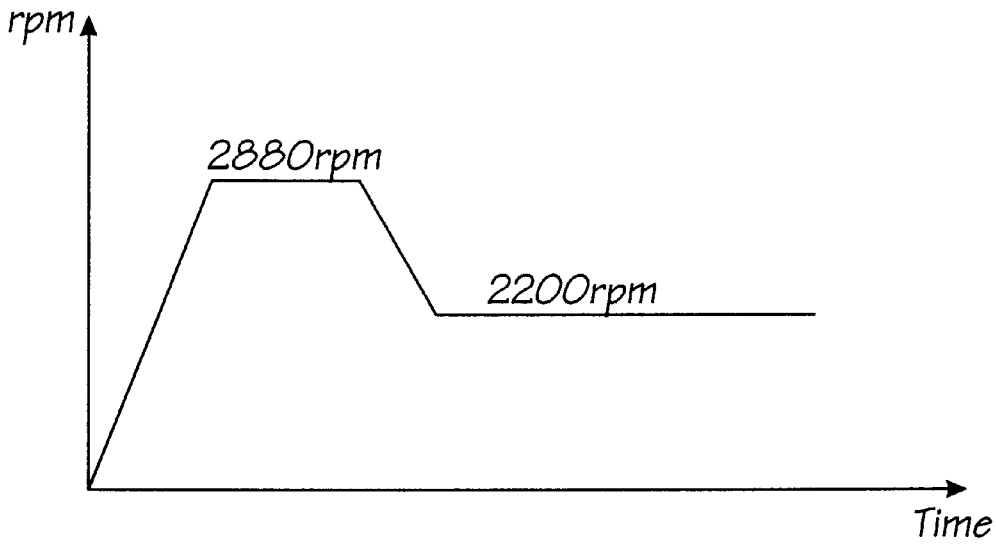
FIG. 5 is a graph showing a change of the rotational speed when starting at a minimum rotational speed according to the present invention.

First, if a starting rotational speed is determined according to a program in a microcomputer 10 of the control board, the microcomputer 10 controls a programmable array logic (PAL) 2 and an inverter 3 through a pulse width modulation (PWM) pulse part 15 and a commutator 12 and applies a frequency of 45~52 Hz to a motor 1 of the reciprocating compressor so that the motor 1 is started. At this time, the reciprocating compressor is operated at a predetermined minimum rotational speed. FIG. 5 show a variation of the rotational speed of the reciprocating compressor.

In FIG. 5, a rotational speed of the reciprocating compressor is 2880 RPM corresponding to the starting frequency (45~52 Hz) and the minimum rotational speed is 2200 RPM.

Figure 6:
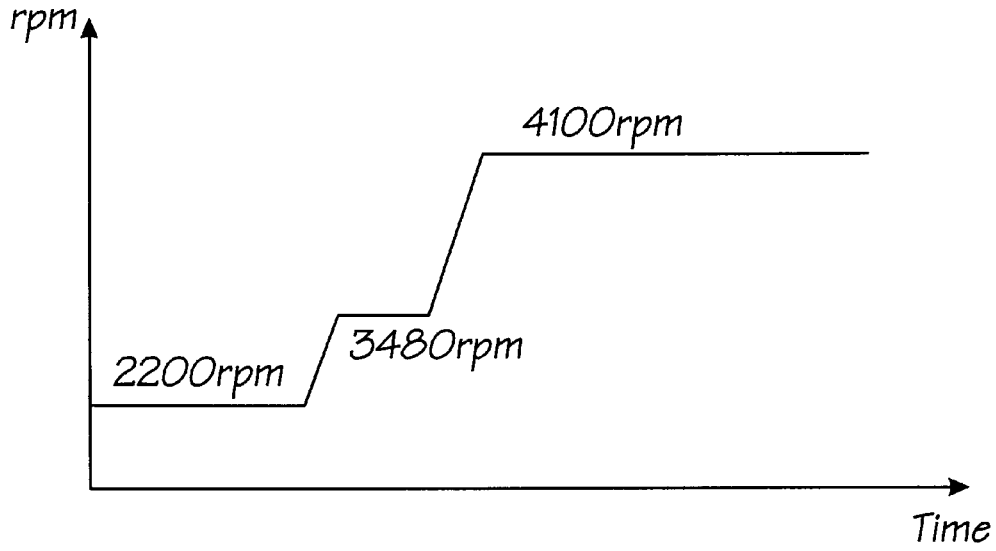
FIG. 6 is a graph showing a change of the rotational speed when changing the rotational speed.

If the starting frequency is applied to the motor 1 and the starting operation is completed (S30), the microcomputer 10 applies a frequency of 52~60 Hz to the motor 1 (S40) so that a noise and vibration due to a sudden change of the rotational speed is minimized when varying the rotational speed from a minimum speed to a maximum speed or reversely. If the reciprocating compressor is normally operated after the starting operation, the microcomputer 10 operates the reciprocating compressor at the predetermined speed (S60). FIG. 6 shows a variation of the rotational speed of the reciprocating compressor.

As shown in FIG. 6, the rotational speed of the reciprocating compressor is increased from 2200 RPM to the 4100 RPM.

According to the present invention, an optimum amount of lubricating oil is supplied to a sliding part of the reciprocating compressor so that the reliability of parts thereof is secured.

This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A method of controlling a reciprocating compressor operated by a single-phase induction motor, said method comprising the steps of:

(1) starting the reciprocating compressor at a minimum speed in which a frequency of 45–52 Hz is applied to the single-phase induction motor;

(2) automatically determining by a programmed microprocessor whether the compressor is operating normally; and (3) when the compressor is operating normally operating the reciprocating compressor at a predetermined normal rotational speed.

2. The method of claim 1, wherein, after the first step and before the second step, the following steps are carried out:

(1a) automatically determining by a programmed microprocessor whether the compressor is operating normally; and (1b) when the compressor is operating normally, operating the compressor at a speed in which a frequency of 52–60 Hz is applied to the motor.

3. A method of decreasing noise and vibration when starting a reciprocating compressor operated by a single-phase induction motor, said method comprising the steps of:

(1) starting the compressor by feeding power to the motor at 45–52 Hz;

(2) automatically determining by a programmed microprocessor whether the compressor has started and is operating normally;

(3) when the compressor has started and is operating normally, feeding power to the motor at 52–60 Hz;

(4) automatically determining by programmed microprocessor means whether the compressor is operating normally;

(5) when the compressor is operating normally, feeding power to the motor at 60 Hz and operating it at a predetermined normal rotational speed.

* * * * *